US006962113B1

(12) United States Patent
Carlson et al.

(10) Patent No.: US 6,962,113 B1
(45) Date of Patent: Nov. 8, 2005

(54) SEGMENTED-ROD WARHEAD

(75) Inventors: Victor John Carlson, Durango, CO (US); Timothy S. Hennessey, Lothian, MD (US); Mary H. Sherlock, Waldorf, MD (US); Windsor Furr, Laurel, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 88 days.

(21) Appl. No.: 10/436,605

(22) Filed: May 9, 2003

(51) Int. Cl.[7] ..... F42B 12/22
(52) U.S. Cl. ..... 102/494; 102/492; 102/506; 102/495; 102/389
(58) Field of Search ..... 102/494, 491, 102/492, 495, 496, 497, 504, 506, 404, 405, 102/406, 403, 389, 474

(56) References Cited

U.S. PATENT DOCUMENTS

| | | | | | |
|---|---|---|---|---|---|
| 1,047 | A | * | 12/1838 | Henderson et al. | 96/377 |
| 1,203,062 | A | * | 10/1916 | Semple | 102/389 |
| 3,026,804 | A | * | 3/1962 | Adler | 102/496 |
| 3,298,308 | A | * | 1/1967 | Throner, Jr. | 102/496 |
| 3,490,374 | A | * | 1/1970 | Nooker | 102/474 |
| 3,498,224 | A | * | 3/1970 | Cordle et al. | 102/496 |
| 3,580,175 | A | * | 5/1971 | Kenney et al. | 102/496 |
| 3,677,183 | A | * | 7/1972 | Talley | 102/495 |
| 3,977,327 | A | * | 8/1976 | Brumfield et al. | 102/494 |
| 4,192,234 | A | * | 3/1980 | McCracken | 102/494 |
| 4,216,720 | A | | 8/1980 | Kempton | 102/67 |
| 4,388,870 | A | * | 6/1983 | Edleson | 102/494 |
| 4,648,323 | A | * | 3/1987 | Lawther | 102/495 |
| 5,117,759 | A | * | 6/1992 | Henderson et al. | 102/496 |
| 5,119,730 | A | * | 6/1992 | Garnett et al. | 102/496 |
| 5,313,890 | A | * | 5/1994 | Cuadros | 102/496 |
| 5,535,679 | A | * | 7/1996 | Craddock | 102/494 |

FOREIGN PATENT DOCUMENTS

| | | | | |
|---|---|---|---|---|
| FR | 2560375 A1 | * | 8/1985 | F42B 12/22 |

* cited by examiner

*Primary Examiner*—Michael J. Carone
*Assistant Examiner*—James S. Bergin
(74) *Attorney, Agent, or Firm*—Fredric Zimmerman

(57) ABSTRACT

The present invention comprises a warhead designed to provide a number of spiraling tendrils composed of segmented rods that move in an increasing radial arc in order to defeat a target. The warhead comprises a substantially cylindrical explosive charge having a plurality of rod segments arranged circumferentially around the explosive charge in a plurality of horizontal layers. As the horizontal layers descend down the explosive charge, the rod segments are offset from those directly above and below them to create a pattern that appears to be twisted columns. The number of columns is equivalent to the number of rod segments in each horizontal layer.

18 Claims, 3 Drawing Sheets

SEGMENTED-ROD WARHEAD

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention pertains to high explosive, directed energy warheads, more particularly to fragmentation warheads, and most particularly to fragmentation warheads wherein the fragments are comprised of segmented circular rods helically positioned around a cylindrical high explosive charge that provide, upon detonation of the explosive, a continuous, spiral killing mechanism consisting of adjacent and interrelated circular rod segments.

2. Description of the Related Art

The basic function of any weapon is to deliver a destructive force on an enemy target. High explosive warheads cause damage by concussion (blast effects) or by penetration of high-energy fragments. In general, there are three types of high explosive warheads that employ the latter method to accelerate metal fragments generally including (1) directed energy warheads, (2) fragmentation warheads, and (3) continuous-rod warheads (CRW).

Directed Energy Warheads, as used herein, refers to Shaped Charge Warheads and Explosively Formed (a.k.a. forged) Penetrators (EFPs) that are said to be directed in that the high explosive energy is focused on a liner, which is typically made of metal. These warheads consist of a hollow liner of thin metal material backed on the convex side by explosive. Upon detonation, a detonation wave sweeps forward and hydrodynamically collapses the liner (in the case of a shaped charge) or deforms the liner (in the case of EFPs) along its axis of symmetry forming a directed jet or EFP which penetrates a localized area on a target of interest.

The directed energy effects concept can be used in multiples, where metal liners/projectiles are distributed, around the circumference of a high explosive charge. In this case, the detonation does not collapse a liner along its linear axis of symmetry, rather, the detonation wave hits the liners perpendicularly (almost symmetrically to the axis of the liners).

High explosive fragmentation warheads constitute one of the most widely used warhead approaches in all types of ammunition. Fragmentation warheads are intended to defeat virtually all types of targets, excluding overburden targets underground and underwater, and heavily armored targets.

In fragmentation warheads, the detonation of the secondary high explosive core generates a large amount of heat and gaseous products. High explosives have an extremely high rate of reaction and the presence of a detonation (shock) wave that moves faster than the speed of sound in the explosive material. Upon detonation, the metal warhead casing almost instantaneously catastrophically fails and bursts, producing a blast of rapidly expanding hot gases and casing fragments.

The rapidly expanding gasses will compress the surrounding air and create a shock wave which propagates outwards at near the speed of sound in air (~340 m/s). The energy of the fragments dissipate more slowly than the energy of a shock wave and, thus, fragments tend to be lethal to a greater range than the blast effects for hard targets.

As a function of design, fragments from a fragmenting warhead have various distribution patterns and lethality characteristics. The fragment distribution pattern is a function of the amount and nature of the explosive material (i.e. how energetic the explosion is), the mass of the fragmenting material, the fragmentation size, and the configuration (geometry, initiation scheme) of the warhead. For example, the detonation of a bomb projects the fragments in an approximate cylindrical pattern and a hand-grenade projects fragments in an approximate spherical pattern.

Uncontrolled fragmentation patterns, such as those used in general-purpose bombs, occur by the natural break up of the outer casing occurring from the detonation of the surrounding explosive charge. This event forms fragments of random size and lethality.

Manipulating the fragment formation process can more predictably control fragmentation patterns and fragment uniformity. Controlled fragment formation can be accomplished in several ways including: designing pre-scored failure regions (grid patterns) on the outer/inner casing or outer surface of the explosive; sandwiching an intermediate mesh material between the outer casing and the explosive core; and, arranging preformed fragments around the main charge explosive such as spheres or cubes.

By controlling the fragment formation process, the relative size and, therefore, the optimized bulk fragment distribution pattern over an area is constrained to maximize the defeat probability/lethality against an anticipated target set of known thickness, obliquity, and material properties.

CRW technology incorporates two overlapping layers of ductile rods that are oriented around the circumference running parallel along the length of an explosive core. The rods are alternately connected together, end-to-end, by a weld (in a zigzag/accordion pleat fashion). Upon detonation, the continuous-rod payload rapidly expands radially outward, bending or "unfolding" the welded ends to form a ring of interconnected rods. A ring of interconnected rods is produced about the axis of the weapon. The ring expands from a highly compressed zigzag pattern to an expanded, almost flat, zigzag pattern using an expansion mechanism similar to a half-plane pantograph. During this expansion, the explosive energy is focused in a single plane such that when the rods strike a target, damage is produced by a cutting action giving it the nickname "flying buzzsaw". The metal density of a normal fragmentation warhead attenuates inversely with the square of the distance ($1/R^2$). However, because it is non-isotropic, the metal density of a continuous-rod payload attenuates inversely as the distance from the point of detonation (1/R). To ensure that the rods stay connected at detonation, the maximum initial rod velocity is limited to the range of 1050 to 1150 meters per second. The initial fragment velocities of fragmentation warheads are in the range of 1800 to 2100 meters per second. Thus, in comparison, CRWs cannot produce as much destructive energy potential as fragmentation warheads. However, the distribution pattern is highly focused, and the rods are interconnected, to increase the relative mass interacting with a target in a highly localized area.

Only one invention known to applicants uses discrete rods in a fragmentation type of warhead and it closely mimics the physical architecture of the CRW (layers of rods that are oriented around the circumference and run parallel and along the length of an explosive core), but without physical interconnections being established between adjacent rods. U.S. Pat. No. 4,216,720 entitled Rod-fragment controlled-motion warhead (RFCMW) discloses destructive fragments used in a warhead that are in the form of discrete tapered rods that are substantially the same length as the cylindrical warhead itself and are placed vertically around and parallel to the axis of the warhead. The warhead system is designed to dynamically rotate the rods to form the expansion and kill radius/mechanism. U.S. Pat. No. 4,216,720 points to some deficiencies of the RFCMW concept as follows: the pattern of these rod-type fragments has been of such a discontinuous nature to results in a high likelihood of missing targets; and, the rods tend to spread in the axial direction, rather than being driven radially.

Another major shortfall of the RFCMW concept is that a high explosive detonation event is used to form the geometric orientation of the rods through a dynamically controlled rotation of each discrete rod to provide the expansion mechanism. The propelling motion is empirically derived for each configuration and optimized to a 90 degree rotation for each discrete rod. If the collective interrelated system of discrete rods under or over rotates, the effective continuous coverage (end-to-end) radius is reduced.

Additionally, the propellering motion of each rod within the RFCMW must have the same angular velocity (and acceleration rate) to ensure the discrete rods do not rotate into each other. The propellering motion of the discrete taper rods requires a perfectly balance rod after that rod has experience some degree of deformation following the explosive detonation of the explosive core. The detonation of the explosive charge will most likely cause spalling and material deformation of the tapered rods, which will randomly change their aerodynamic characteristics while unpredictably shifting the center-of-balance and, thus, introducing random discontinuities in the propellering motion of each discrete rod. If a single rod does not perform as designed or if one discrete rod prematurely encounters an obstacle (such as topography, a tree, etc.) before reaching the target, its rotation will be significantly altered and cause a domino effect whereby the interrelated discrete rods tumble into each other and consume the effective warhead energy.

A further major shortfall in the RFCMW is the aerodynamic stability of this concept whereby the end effect must be achieved by a highly controlled formation pattern that is achieved by dynamic, balanced rotation that is highly intolerant of drift, asymmetries, and induce asymmetries such as spalling and material deformation following the warhead detonation. Time sequencing of six degrees-of-freedom motion must be achieved to propel the discrete rods radially outward, while they are simultaneously and dynamically rotating about their respective precise center axes. This requires that each discrete rod rotates at the same angular rate while experiencing a uniform velocity ratio (uniform velocity to mass ratio) during and after an explosive event across the entire length of the discrete rod which has an unusually high aspect ratio (the claimed length-to-diameter ratio is 28:1) so that all portions are subjected to both the same an outward and angular velocity to arrive at an end-to-end disposition.

Other shortfalls of the RFCMW concept are as follows: the tapered rods will reduce the penetration capability at the thinned portion of the rods and therefore reduce the damage level to the intended target; and, it is doubtful that the warhead is relatively inexpensive as claimed—the warhead would be relatively expensive due to the understanding that the RFCMW requires relatively high control of rod material properties, highly toleranced machined metal parts, manufactured parts, and fabricated assemblies, and a potentially complex explosive initiation system to ensure effective results (also true for a CRW).

Therefore, it is desired to provide a radially expanding kill effect similar to the CRW by using geometrically prearranged segmented circular rods placed horizontally (perpendicular to the warhead axis) around a cylindrical warhead to produce a geometrically coupled, helical spirally ring of interrelated and adjacent segmented circular rods upon detonation of the explosive core, to increase the effective mass on the target within a localized region, to create multiple impact sites within a projected height, to create lethality at and somewhat beyond the full expansion diameter of the warhead, and to create unique target defeat mechanisms compared to that of the CRW or that of all known prearranged fragmentation warheads.

SUMMARY OF THE INVENTION

The present invention comprises a warhead that achieves greater cumulative and synergistic effects than a fragmentation warhead and with a kill effect similar to the CRW. The Segmented Rod Warhead (SRW) is a high explosive warhead designed to radially project mechanically and geometrically prearranged fragments, in the form of multiple layers of discrete and helically wound circular segmented rods, in a prescribed, highly controlled, parallel path and radial distribution, such that at full expansion, the adjacent, individual rods align themselves end-to-end in a helical, stair-step fashion to form a continuous spiral to defeat a target, rather than pepper a target with a distribution of fragments. The expansion mechanism is radial, meaning the height of the warhead cylinder dictates the cylindrical height of the kill region. The radius at full expansion is mathematically derived from the diameter of the packaged warhead and the arc length of the discrete circular rod segments. The SRW focuses the available warhead energy on a localized area of a target in a non-isotropic fashion. This cumulative and synergistic effect greatly weakens a target by the concentration and interaction of mechanically arranged adjacent rod segments within the same localized failure region as compared to a wide spread distribution of fragments over a target of interest.

Accordingly, it is an object of this invention to provide a warhead that projects mechanically and geometrically prearranged fragments that align themselves side by side in a stair stepping fashion to form a helical spiral.

It is a further object of this invention to provide a warhead that focuses available warhead energy on a localized area of a target in a non-isotropic fashion.

A still further object of this invention is to provide a warhead that achieves greater cumulative and synergistic effects than a standard fragmentation warhead.

A further object of this invention is to provide a warhead having energy producing devices in the SRW core that can project the segmented rods at lower velocities including low explosive technologies, air bag (gas generator) technologies, and commercial energy sources including hydraulic, pneumatic, and electromagnetic devices.

This invention accomplishes these objectives and other needs related to controlled fragmentation and continuous rod warheads by providing a warhead having a plurality of rod segments arranged circumferentially around a substantially cylindrical energetic charge in a series of horizontal layers (approximately perpendicular to the warhead axis). The horizontal layers are placed in a pattern where each rod segment is offset to the one directly above and below it, essentially creating twisting helical columns around the energetic charge. When the energetic charge is detonated, the rod segments are forced outwards horizontally causing the rod segments to expand in a helical pattern, substantially comprising a number of spiraling tendrils equivalent to the number of rod segments within each horizontal layer. The concentrated helical spiral of rod segments continues to cylindrically and radially expand until such time as the optimal expansion diameter is exceeded and gaps between adjacent rods begin to occur. The preferred energy source to expand the rods occurs when the energetic charge comprises a high explosive core that detonates to produce a shock wave.

Additionally, the rod projection within the same configuration can be achieved with different energy producing sources used to project the rods radially at lower velocities with different acceleration profiles for other weapons applications to include: (1) a low explosive (propellant) impulse cartridge that generates mechanical thrust to propel the prearranged rods out radially, and (2) a gas generator inflation systems (airbags), where the same expansion mechanism occurs at even slower rates using chemically reactive substances that react very quickly to produce a large pulse of hot gas that expands a bag located within the core to radially propel the rods.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

The invention, as embodied herein, comprises a cylindrical warhead designed to provide a number of spiraling tendrils composed of segmented circular rods that move collectively in an increasing radial arc in order to defeat a target. The warhead comprises a substantially cylindrical energetic charge having a plurality of circular rod segments arranged circumferentially around the explosive charge in a plurality of horizontal layers (approximately perpendicular to the axis of the warhead). As the horizontal layers descend down the length of the explosive charge, the rod segments are offset from those directly above and below them to create a pattern that appears to be twisted helical columns. The number of columns is equivalent to the number of rod segments in each horizontal layer.

Figure 1A:
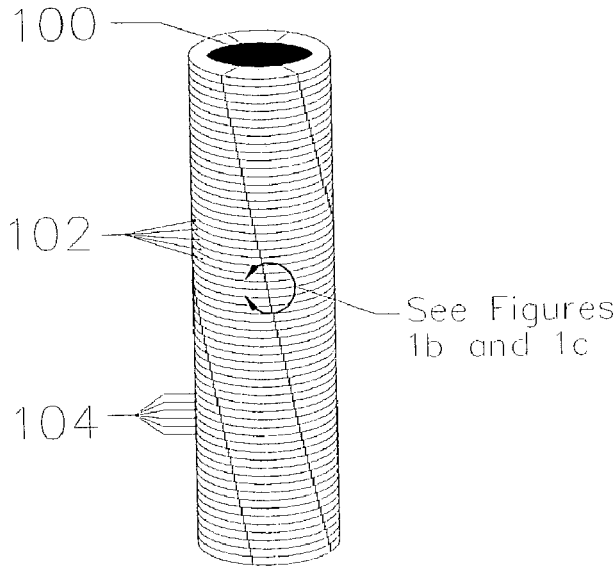
FIG. 1*a* is a side view of one embodiment of the invention.
Figure 1B:
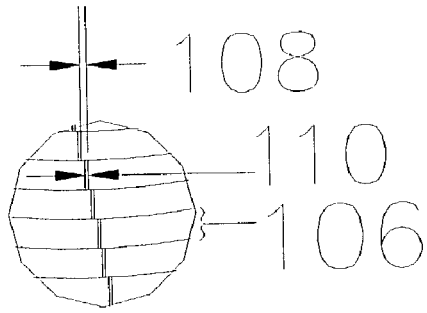
FIG. 1*b* is a close-up view of a section of the embodiment shown in FIG. 1*a*.
Figure 1C:
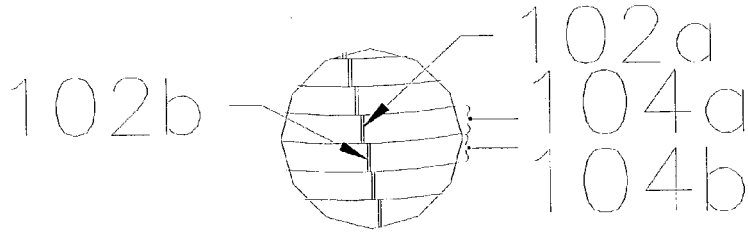
FIG. 1*c* is the view shown in FIG. 1*b*, showing different features of the invention.

Referring to FIGS. 1*a*–1*c*, the invention comprises a warhead having a substantially cylindrical energetic charge 100 surrounded by a plurality of circular rod segments 102. The rod segments are arranged in a plurality of horizontal layers 104. Each horizontal layer 104 is placed in a vertical position 106 that is offset 108 from the rod segment 102 directly above and below it. This creates the pattern of apparently "twisted" columns represented as a helical staircase of rod segments that appears in FIG. 2. The warhead, is comprised of three or more rod segments 102 in each horizontal layer 104. Because the rod segments 102 must surround a substantially cylindrical shape, they will normally be curved to form a reasonably tight circle around the energetic charge 100. Gaps (spaces) 110 between the rod segments 102 are expected to facilitate packaging and manufacturing of the warhead and to allow for some tolerance of dynamic perturbations or inherent asymmetries associated with manufacturing procedures and practices.

Additionally, the energetic charge 100 can consist of a right circular cylinder of such a height that is substantially comprised of the warhead height or it can be manufacture as a right circular cylinder that is substantially the height of the horizontal layer 104. In this way, the horizontal layer 104 becomes the building block for the warhead.

The invention was originally developed to work with an energetic charge 100 comprising a high explosive charge that is 38.5 inches in length. While the substance of the high explosive charge may be selected by one skilled in the art, it is preferred that the explosive charge be selected to radially project the rod segments 102 at velocities ranging from about 400 to about 700 meters per second. Reasons for this preferred velocity range are associated with a tolerable deformation of the rod segments following the explosive core detonation. Higher rod velocities may jeopardize the mechanical and structural integrity of the rods and the interrelationships of the rod segments during expansion.

Examples of explosive charge materials that can provide velocities in this range include high explosive materials that detonate (instead of deflagrating or burning) with the rate of advance of the reaction zone into the unreacted explosive material exceeding the velocity of sound in the unreacted material. Such high explosives include C-4 high explosive, PBNX-9 explosive, Comp B high explosive or the like. The initiation system for the high explosive charge can be end initiated such that the explosive shock wave (detonation) sweeps from the point of initiation through the explosive or it can be multi-point initiated, where an initiation source, such as detonation cord that runs down the axis of the explosive charge and each layer 104 has its own booster explosive to complete the initiation train. The detonation cord propagates a detonation wave to each booster in a horizontal layer 104, which in turn detonates the high explosive main charge within this layer.

Different energy sources can be used achieve a numerous terminal effects for the segmented rod warhead. One skilled in the art can readily select an energetic charge 100 to design a segmented rod warhead with the appropriate energy source to arrive at the desired terminal effect. The terminal effects and kill mechanisms depend on the application or the threat being countered. Additionally the terminal effect is influenced by the synergistic effects of the segmented rod(s) which determine the terminal kinetic energy, the terminal momentum, the duration of the impact, which is a function of the material and impactor (segmented rod) material properties, the impact (contact) area, and the cross-sectional density and shape of the impactor and the target. Fore example, heavier rods launched at lower velocities provide a different kill mechanism, such as plugging or punching, when compared to lighter and faster rods which may cut and penetrate a target.

While one preferred energetic charge 100 comprises a high explosive charge, the energetic charge 100 may also be extremely insensitive explosives, such as (PBXIH-135), propellant impulse cartridges similar to those for cartridge and propellant actuated devices that can be black powder and smokeless powder (impulse cartridges typically supply 400,000 foot-pounds per pound of propellant), and gas generator inflation systems (airbags), similar to those used in automobile crash airbags, to project the prearranged segmented rods 102 radially at low velocity regimes (20–150 fps). Lower energy energetic charges 100 may also be employed for applications such as ballistic spreader (gun) devices, such as those used to spread packed parachutes or canopies. Such a spreader device can employ a low explosive (propellent impulse cartridge) core that projects the rod segments 102 which are attached to suspension lines on the parachute canopy skirt opening the parachute and allowing the canopy to fill quickly.

The number of rod segments 102 per horizontal layer 104 may be selected by one skilled in the art depending upon the kill radius desired, the characteristics of the target, the warhead deployment methodology, and size of warhead chosen, but a minimum of three rod segments 102 per horizontal layer 104 are required. For the 38.5 inch warhead described above, four rod segments 102 per horizontal layer 104 are preferred. Also, for the 38.5 inch warhead, the preferred outer diameter of each rod segment is 5.75 inches and the preferred thickness is 0.315 inches. If 360 degree coverage for the warhead is desired, the offset angle is selected by ensuring that the vertical position of the right end 102*a* of each rod segment 102 in the top horizontal layer 104*a* lines up with the vertical position of the left end 102*b* of each rod segment 102 in the bottom horizontal layer 104*b*. Additionally, small offsets between the right end 102*a* of the top layer 104*a* and the left end 102*b* of the bottom layer 102*a* can be calculated. Therefore, to obtain the preferred offset 108 one would divide the arc of the rod segment 102 by the number of horizontal layers 104. For the 38.5 inch warhead described above, this results in an offset 108 of approximately 1.5 degrees.

The following tables provide more information related to the potential geometries discussed above. Table I provides geometry data related to expansion for a single spiral 5.75 inch outer diameter rod segment 102. Table II provides geometry data related to expansion for a single spiral 10.6 inch outer diameter rod segment 102. Table III provides expansion diameters for some different size warheads assuming chord lengths of the rod segments 102 of 4.0+/−0.1 inches.

TABLE I

Geometry Data for Single Spiral 5.75" Rod Segment

| | |
|---|---|
| OD (ROD SEGMENT OD) | 5.75 in |
| ID (ROD SEGMENT ID) | 4.50 in |
| INCLUDED ANGLE OF ROD | 90° |
| ROD THICKNESS | 0.315 in. |
| SRW TOTAL HEIGHT | 38.5 in |
| SRW COVERAGE | 720° |
| NO. OF LAYERS FOR COVERAGE | 122 |
| CHORD LENGTH | 4.07 in. |
| MEMBER SIZE: | |
| TETRAHEDRON | 4" × 4" × ⅝" |
| HEDGEHOG TARGET | 4" × 4" × ⅔" |

TABLE II

Geometry Data for Expansion of a Single Spiral 10.6" Outer Diameter Rod Segment

| ORDNANCE | OUTER DIAMETER (INCHES) |
|---|---|
| 155 mm (6.1-inch) | 5.75 |
| Mk 82 | 10.6 |
| Mk 83 | 14.0 |
| Mk 84 | 18.0 |

TABLE III

Expansion Diameters for Different Size Warheads Assuming 4.0" Chord Length Rod Segments

| # OF ROD SEGMENTS | ANGLE OF SEGMENT (Degrees) | ARC LENGTH (INCHES) | CHORD LENGTH (INCHES) | ANGLE BETWEEN RODS IN A SINGLE COLUMN (Degree) | # OF SEGMENTS PER SINGLE SPIRAL (360 Degrees) | CIRCUMFERENCE (INCHES) | FULL EXPANSION DIAMETER (INCHES) | FULL EXPANSION DIAMETER (Feet) |
|---|---|---|---|---|---|---|---|---|
| 1 | 360 | 18.0642 | 5.7500 | 5.90 | 61 | 350.75 | 111.65 | N/A |
| 2 | 180 | 9.0321 | 5.7500 | 2.95 | 122 | 701.50 | 223.29 | 18.16 |
| 3 | 120 | 6.0214 | 4.9796 | 1.97 | 183 | 911.27 | 290.07 | 24.17 |
| 4 | 90 | 4.5160 | 4.0659 | 1.48 | 244 | 992.07 | 315.79 | 26.32 |
| 6 | 60 | 3.0107 | 2.8750 | 0.98 | 366 | 1952.25 | 334.94 | 27.91 |
| 8 | 45 | 2.2580 | 2.2004 | 0.74 | 488 | 1073.81 | 341.81 | 28.48 |
| 10 | 36 | 1.8064 | 1.7768 | 0.59 | 610 | 1083.87 | 345.01 | 28.75 |
| 12 | 30 | 1.5053 | 1.4882 | 0.49 | 732 | 1089.87 | 346.76 | 28.90 |
| 15 | 24 | 1.2043 | 1.1955 | 0.39 | 915 | 1093.87 | 348.19 | 29.02 |
| 18 | 20 | 1.0036 | 0.9985 | 0.33 | 1098 | 1096.34 | 348.98 | 29.08 |
| 24 | 15 | 0.7527 | 0.7505 | 0.25 | 1464 | 1098.76 | 349.75 | 29.15 |
| 60 | 6 | 0.3011 | 0.3009 | 0.10 | 3660 | 1101.39 | 350.58 | 29.22 |

The materials selected for the rod segments 102 may be selected by one skilled in the art depending upon the warhead characteristics, the properties of the intended target being countered, and the energetic material selected. Preferred materials for the rod segments 102 comprise a strength greater than about 120 kpsi. Examples of such materials include S7 tool steel, 4340 steel, and titanium 6AI-4V. In another embodiment of the invention, the rod segments comprise explosively deployed and initiated smoke obscurants, such as red phosphorus. This would allow the invention to be used to deploy smoke obscurant rather than damage targets directly. Rod segment 102 materials can also include softer materials such as rubber, bean bag, or plastic that produce a painful but less that lethal blunt impact for application in less that lethal mines less than lethal grenades, animal/riot control and area denial applications.

Figure 2:
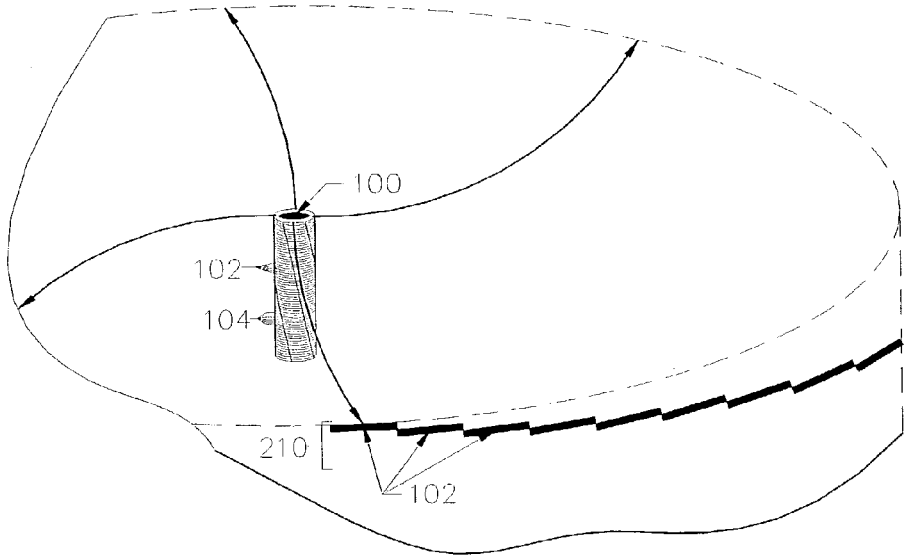
FIG. 2 shows flight path trajectories for the rod segments of the embodiment of the invention shown in FIG. 1 and a partial view of one column at full expansion.
Figure 3:
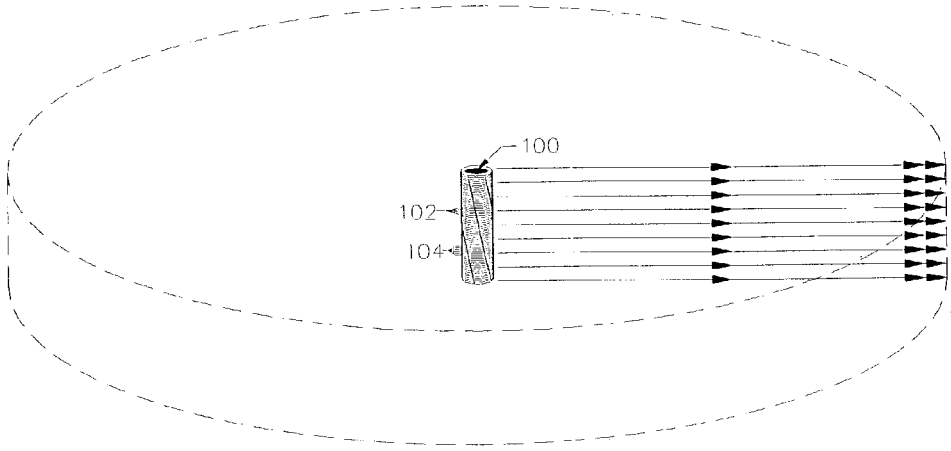
FIG. 3 shows the pure radial expansion characteristics where the height of the expanding lethal radius is defined by the height of the warhead and the full expansion diameter is a function of the warhead and the number/arc length of the respective rod segments.

Referring to FIGS. 2 and 3, in operation, the explosive charge 100 will detonate and drive the rod segments 102 in a substantially horizontal direction that remains in line with the rod segments' 102 horizontal layer 104. This will cause the rod segments 102 to form a series of stair-step like patterns 210 that expand in a radial direction around the energetic charge 100. The rod segments 102 are driven at velocities normally anticipated to be between 400 to 700 meters per second as noted above. This velocity range will minimize the spalling and deformation of the rod segments 102. Any significant rod segment 102 spalling or deformation may impede the ability of a particular rod segment 102 to expand in a predictable way relative to the adjacent rod segments 102. The lower velocity regimes assist in controlling the expansion of the rod segments 102 relative to one another (not in a general dispersal pattern). If the explosive core is replaced by a less energetic material, spalling can be eliminated but the velocity will drop and the damage mechanism is altered.

One skilled in the art can modify the present invention to adjust the killing mechanism depending upon the requirement of the warhead. In general, as described above, the invention produces a killing mechanism of an unbroken, spiraling ring of adjacent rod segments at any angular swept pattern mathematically defined by the design of the warhead. Depending upon the energy source, the following patterns may be achieved: a 360 degree spiraling ring, multiple (720 degree 1080, etc degree) spiraling rings, or a partial (such as 90 degree, 180 degree, or 270 degree) spiral. The spiraling rings will comprise multiple coverage fans as a factor of warhead height covering the same arc as the spiraling ring pattern.

Although the above referenced preferred velocity range comprises slightly lower velocities than some other high explosive fragmentation warheads, and, therefore, damage potential of high velocity fragments may be reduced, predictably projecting a series of rod segments 102 such that adjacent rod segments 102 are aligned in a predictable fashion to form a stair-stepped spiraling ring of coverage radiating from the axis of the energetic charge 100 focuses the available warhead energy on a localized area of a target, thereby increasing the warhead's synergistic effects. As such, with proper placement, it is much more effective at defeating structural targets, such as steel beams and the like than a typical fragmentation warhead.

One can also practice the invention by replacing the energetic charge 100 with a different energy source such as an electromagnet coil core, which upon triggering, magnetizes the coil, to radially repel the rod segments 102 or pneumatic or hydraulic accumulators where prestored air or hydraulic power is released to propel the rod segments 102.

Finally, the invention also includes a method of using the above described warhead to provide a ring of radially expanding rod segments that form a focused helical ring of rod segments that synergistically couple to defeat a target.

What is described are specific examples of many possible variations on the same invention and are not intended in a limiting sense. The claimed invention can be practiced using other variations not specifically described above.

What is claimed is:

1. A warhead, comprising:

a substantially cylindrical energetic charge, said substantially cylindrical energetic charge comprising a central axis; and a plurality of rod segments arranged circumferentially around the substantially cylindrical energetic charge in a plurality of horizontal layers oriented substantially perpendicular to the central axis, wherein the plurality of rod segments in each horizontal layer comprise vertical positions offset from vertical positions, which are substantially parallel to the central axis, of the plurality of rod segments in the horizontal layers directly above and below, wherein initiation of the warhead causes the plurality of rod segments to move in a pattern substantially comprising a number of spiraling tendrils equivalent to a number of rod segments within each horizontal layer, and wherein the plurality of rod segments are comprised of individual arc-shaped rod segments; and wherein the offset comprises an angle of approximately an arc length of each of the plurality of rod segments divided by a total number of the plurality of horizontal layers.

2. The warhead of claim 1, wherein the substantially cylindrical energetic charge comprises a high explosive charge.

3. The warhead of claim 1, wherein each of said plurality of horizontal layers comprises at least three rod segments.

4. The warhead of claim 1, wherein the substantially cylindrical energetic charge drives each of said plurality of rod segments in a radial direction approximately parallel to the plurality of horizontal layers.

5. The warhead of claim 1, wherein the substantially cylindrical energetic charge creates an explosive shock wave that moves the plurality of rod segments at a velocity ranging from about 400 meters per second to about 700 meters per second.

6. The warhead of claim 1, wherein each of the individual arc-shaped rod segments comprises a curved shape forming a circular shape substantially against an outer peripherii of the explosive charge.

7. The warhead of claim 1, wherein the substantially cylindrical energetic charge comprises a predetermined height of approximately 38.5 inches.

8. The warhead of claim 1, wherein each of said plurality of horizontal layers comprises four rod segments.

9. The warhead of claim 1, wherein each of the individual arc-shaped rod segments comprise an outer diameter length of about 5.75 inches.

10. The warhead of claim 1, wherein the offset comprises an angle of approximately 1.5 degrees.

11. The warhead of claim 1, wherein each of the individual arc-shaped rod segments comprise a thickness of approximately 0.315 inches.

12. The warhead of claim 1, wherein each of the individual arc-shaped rod segments comprise a material comprising a predetermined strength greater than about 120 kpsi.

13. The warhead according to claim 1, wherein said individual arc-shaped rod segments are individual curved-shaped rod segments.

14. The warhead according to claim 1, wherein said individual arc-shaped rod segments each comprise a chord length.

15. The warhead according to claim 1, wherein said individual arc-shaped rod segments each comprise a curve-shaped inner surface substantially adjacent said substantially cylindrical energetic charge and a curve-shaped outer surface.

16. The warhead according to claim 1, wherein said individual arc-shaped rod segments each comprise an outer diameter greater than a thickness.

17. A method of providing a spiraling ring of radially expanding rod segments to defeat a target, comprising:

providing a warhead comprising a substantially cylindrical explosive charge, said substantially cylindrical energetic charge comprising a central axis, and a plurality of rod segments arranged circumferentially around the substantially cylindrical energetic charge in a plurality of horizontal layers oriented substantially perpendicular to the central axis, wherein the plurality of rod segments in each horizontal layer comprise vertical positions offset from vertical positions, which are substantially parallel to the central axis, of the plurality of rod segments in the horizontal layers directly above and below, wherein initiation of the warhead causes the plurality of rod segments to move in a pattern substantially comprising a number of spiraling tendrils equivalent to a number of rod segments within each horizontal layer, and wherein the plurality of rod segments are comprised of individual arc-shaped rod segments; and wherein the offset comprises an angle of approximately an arc length of each of the plurality of rod segments divided by a total number of the plurality of horizontal layers; and, initiating the warhead.

18. A warhead, comprising:

a cylindrical energetic charge, said cylindrical energetic charge comprising a central axis; and rod segments arranged circumferentially around the cylindrical energetic charge in a plurality of layers oriented substantially perpendicular to the central axis, wherein the rod segments of said plurality of layers are positioned to create a twisted, helical staircase pattern of said rod segments, and wherein the rod segments are comprised of individual arc-shaped rod segments, each of said individual arc-shaped rod segments comprises a curved inner surface; and wherein the rod segments in any layer of said plurality of layers are offset from the rod segments in another layer of said plurality of layers.

* * * * *